US006214169B1

(12) United States Patent
Ruf et al.

(10) Patent No.: US 6,214,169 B1
(45) Date of Patent: Apr. 10, 2001

(54) SHEET FORMATION SYSTEM WITH DECKLE PLATES AND METHOD FOR REDUCING EDGE WAVES

(75) Inventors: Wolfgang Ruf, Herbrechtingen-Bolheim; Thomas Dietz, Königsbronn; Konstantin Fenkl, Rammingen, all of (DE)

(73) Assignee: Voith Sulzer Papiermaschinen GmbH, Heidenheim (DE)

( * ) Notice: Subject to any disclaimer, the term of this patent is extended or adjusted under 35 U.S.C. 154(b) by 0 days.

(21) Appl. No.: 09/141,339

(22) Filed: Aug. 27, 1998

(30) Foreign Application Priority Data

Aug. 29, 1997 (DE) ..... 197 37 646

(51) Int. Cl.[7] ..... D21F 1/56
(52) U.S. Cl. ..... 162/212; 162/346; 162/353
(58) Field of Search ..... 162/353, 334, 162/354, 346, 212, 216

(56) References Cited

U.S. PATENT DOCUMENTS

| | | | | |
|---|---|---|---|---|
| 1,734,929 | * | 11/1929 | Vedder | 162/346 |
| 3,150,035 | | 9/1964 | Eddy | 162/353 |
| 3,281,314 | * | 10/1966 | Bennett | 162/346 |
| 3,607,624 | | 9/1971 | Moody et al. | 162/353 |
| 4,081,321 | * | 3/1978 | Wolf et al. | 162/346 |
| 4,738,751 | * | 4/1988 | Newcombe | 162/353 |
| 4,968,387 | | 11/1990 | Beran et al. | 162/353 |
| 5,302,250 | | 4/1994 | Peterson et al. | 162/353 |

FOREIGN PATENT DOCUMENTS

| | | | | |
|---|---|---|---|---|
| 500956 | | 7/1930 | (DE) . | |
| 4334641 | | 4/1994 | (DE) . | |
| 0445564 | | 9/1991 | (EP) . | |
| 2128252 | * | 3/1971 | (FR) | 162/353 |

* cited by examiner

*Primary Examiner*—Karen M. Hastings
(74) *Attorney, Agent, or Firm*—Greenblum & Bernstein, P.L.C.

(57) ABSTRACT

Sheet formation system and method for reducing wavy edges in a fourdrinier machine. The system includes a headbox having a nozzle bring adapted to produce a pulp suspension jet across a width of the machine, at least one rotating screen positioned to receive the pulp suspension jet, and at least two deckle plates adjacent to the screen. The deckle plates may be adjustably positionable such that a distance between the deckle plates and a centerline of the screen is adjustable in a machine direction over a substantial portion of a length of the side shields. The method includes directing a pulp suspension jet onto the rotating shield between the deckle plates to form a web sheet, moving the web sheet in a machine direction, and adjusting a distance between the deckle plates as the web sheet is moved in the machine direction. The method also includes positioning the mechanical deckle plates having a flat surface being adapted to face the pulp suspension in the pulp suspension application area to form edges of the sheet being formed and bending the flat surface of the mechanical deckle plates as the formed sheet travels in a machine direction.

28 Claims, 3 Drawing Sheets

SHEET FORMATION SYSTEM WITH DECKLE PLATES AND METHOD FOR REDUCING EDGE WAVES

CROSS-REFERENCE TO RELATED APPLICATIONS

The present application claims priority under 35 U.S.C. §119 of German Patent Application No. 197 37 646.0, filed on Aug. 29, 1997, the disclosure of which is expressly incorporated by reference herein in its entirety.

BACKGROUND OF THE INVENTION

1. Field of the Invention

The present invention is related to a sheet formation system for a fourdrinier machine for producing, e.g., paper or cardboard, and to a method for reducing edge waves in a sheet formation system.

2. Discussion of Background Information

Sheet formation systems for fourdrinier machines include an endless screen (sieve) for formatting paper or cardboard webs that is guided or runs over an open, flat table surface. Pulp heavily diluted with water, i.e., pulp suspension, is added to a headbox that produces a pulp suspension jet through a nozzle that extends along the width of the machine and that directs the pulp suspension jet onto the endless screen. Subsequently, fluid is drained through the screen and a pulp web is produced. The pulp web is then guided through the machine and is processed into a finished paper web or cardboard web.

After an impact point of the pulp suspension jet upon the screen, the pulp suspension at the edges of the screen tends to run off laterally. For this reason, in the area of the edges of the screen, i.e., after the nozzle of the headbox, so called deckle plates (or a deckle pan assembly) are attached to prevent both a lateral flow of the pulp suspension and a thinning of the produced paper or cardboard web in this area.

Deckle plates of the type generally discussed above are known from, e.g., Patent Application DE 43 34 641 A1, the disclosure of which is expressly incorporated by reference herein in its entirety. This document discloses as its object preventing permanent accumulation of fiber layers that form in the area of the edges of a flowing pulp suspension. The accumulation of fiber layers results from drying and these dried layers may flake into the fresh pulp suspension. For this purpose, the noted document discloses providing spray nozzles in the area of the deckle plate to cover the deckle plate surfaces with a flowing aqueous film, so as to prevent drying-on of pulp accumulations. The deckle plate itself is comprised of a flat strip or deckle edge which is strengthened in its directional stability by hollow sections aligned in a machine direction.

A major problem with the known deckle plate is that, in the area of the edge, secondary flows develop from the pulp suspension flowing past the boundary layers, and these secondary flows disadvantageously produce wavy edges in the pulp suspension that run toward the machine center.

SUMMARY OF THE INVENTION

The present invention provides a sheet formation system of a fourdrinier machine that includes deckle plates for substantially reducing or substantially preventing the formation of wavy edges in the pulp suspension.

Further, the present invention provides a method for reducing wavy edges in a sheet formation system of a fourdrinier paper or cardboard machine in an area in which the pulp suspension is applied.

Accordingly, the present invention provides deckle plates (a deckle pan assembly) that are positioned adjacent to an endless screen so that a distance between the deckle plates and a centerline of the screen is adjustable in a machine direction over a considerable part of a length of the shields. Further, the present invention provides a method that includes continuously widening a flat side of the pulp suspension in an area of the edges of sheet formation.

The inventors of the present invention discovered that the problem with edges in the sheet formation system is a problem at an interface between the headbox and the screen section of the web producing machine. The problem arises from the control of the jet opening, the associated reflected wave, and the limits set for the sheet size during sheet formation. While developments in the headbox area have resulted in improvements in the cross-directional profile of the web, these improvements, e.g., sectioning of the headbox to control pulp density, may more negatively effect the web edge than the previous systems.

The causes of wavy edges or reflected waves may have various origins. Generally, wavy edges are caused by edge effects that arise in the form of curved secondary flows that move toward an upper part of the deckle plate. Because of the large wetted areas, the flow in the edge area may be considerably retarded and may, due to continuity conditions, occupy a larger space along the wall. Thus, the slower edge flow substantially blocks the desired flow of the main flow moving substantially along the length of the deckle plate. As a result, the jet is deflected locally toward the machine center, which has the appearance of a reflected wave.

This problem may particularly occur with slow-running machines having large nozzle openings. In this manner, the reflected waves have ample time to expand to the fourdrinier in the web production area. While the various effects are slightly weaker with fast machines, in principle, the problems exist here also.

Secondary flows may occur as the result of various effects. For structural reasons, the orifice of the nozzle may be smaller than the space provided between the deckle plates. As a result, an opening between the orifice and the deckle plate is created. Ideally, this opening should be approximately 0.15 mm, but should not exceed approximately 0.25 mm. A groove in the orifice seal cannot be extended to the tip of the opening, thus, an automatic seal in this area, which is caused by fibers, particularly in faster machines, is made more difficult because of the prevailing high pressure. Further, in addition to the secondary flow at the deckle plate, problems, e.g., splashing, contamination of the screen section, and braid formation, may occur. These problems can result in considerable interference, particularly if the opening is too large, e.g., as a result of an orifice position not centered in the middle of the machine.

Another possibility of creating secondary flows may be through wall friction. That is, as a result of wall friction in the headbox and at the deckle plate, a boundary layer may be produced that has a flow speed slower than that of the central main flow. Without the deckle plates, the deposited pulp suspension would tend to laterally expand and to produce a larger volume required by the slower speed of flow. Because this expansion is prevented by the deckle plate limits, an upwardly curved secondary flow develops at the deckle plate.

Another manner in which secondary flows are created is that the jet, at a jet impact point, receives a generally strong impulse in the transverse direction as a result of change in flow direction due to lateral expansion. Thus, the transverse impulse results in an additional, curved secondary flow at the deckle plate, the effect of which largely depends on an impact angle between the screen section and the headbox position.

Secondary flows may also arise out of screen joggling, in which speed components are impressed upon the pulp suspension in the cross machine direction. Due to a defined sheet size limits, resulting impulses are reflected toward a center of the web as a wavy edge.

Accordingly, the inventors of the present invention have found that reflection waves or the wavy edges can be reduced by providing adequate space for lateral expansion of the secondary flow.

While adequate space may be provided with the known, non-flexible deckle plates such that, depending upon a specific requirement, an opening may be set between the screen and the deckle plate. In this manner, a substantial portion of the impulse may be laterally "released" to substantially reduce the wavy edge. However, in this area it is also necessary to avoid build-up of pulp through the spray pipes. A solution to this consequential problem is described in the above-noted document DE 43 34 641 A1.

It is also possible to provide a space through the deckle plate contour for the undesired secondary flow so as not to restrict the main flow or not to divert the secondary flow toward the center of the machine. This can be provided, e.g., with an adjustable deckle plate that is able to influence the flow shortly after it is ejected from the nozzle. The secondary flows, which would otherwise tend to curve upwards at the deckle plate, may be laterally displaced to reduce reflected waves or to conduct the secondary flow in a controlled manner closer to the edge without foregoing the feature of size limitation. Thus, the deckle plate can be adjusted such that, as the distance from the headbox increases, the area for the pulp suspension widens.

This deckle plate of the present invention may be a multi-part design, e.g., preferably a two-part design, and, starting at the end of the table, the deckle plate is composed of a structural element, e.g., preferably a plastic element, that is bendable in a controlled manner via tensioning elements. As a result of the adjustability of the design of the deckle plate, which includes vertical adjustability with respect to the screen surface, the deckle plate can be set very closely to the screen, e.g., preferably approximately 0.5 mm.

According to an exemplary embodiment, the present invention provides a known sheet formation system of a fourdrinier paper or cardboard machine having a headbox and at least one rotating screen with at least two deckle plates positioned in an area of the edges of the screen. The lateral deckle plates may be coupled to the sheet formation system so that a distance between the lateral shields may increase at least over an increasing distance in the machine direction.

Moreover, it may be advantageous to provide elastically adjustable lateral shields, at least in sections spaced along the machine direction. The elastic arrangement of the deckle plate may be provided, e.g., by weakening the material strength of the deckle plate in a direction perpendicular to the screen level or by sectionally replacing the material with a particularly elastic material, such as synthetic material or rubber.

In another embodiment of the present invention, each lateral shield may include at least one device adapted for shaping the lateral deckle plates at least in the machine direction. At least one of the devices for shaping the lateral deckle plates may utilize a tensile and/or pressure force with at least one direction component that is transverse to the machine direction and/or may engage a lever arm that is arranged laterally to the deckle plate that utilizes a tensile and/or pressure force with at least one direction component in the machine direction.

According to the present invention, a method for reducing wavy edges in a sheet formation system of a fourdrinier paper or cardboard machine in the area of pulp suspension application onto a rotating screen is provided. During the pulp suspension application, the method includes mechanically limiting lateral edges of the sheet being formed, and the area of the edges of the sheet formation area for pulp suspension is increasingly and continuously adjustable in the machine direction.

The method of the present invention also includes enlarging the area in accordance with a continuity equation for incompressible liquids subject to a change in flow speed in the area of the edges, thereby maintaining a constant height of the layer of the pulp suspension in the area of the edges.

Accordingly, the present invention is directed to a sheet formation system of a fourdrinier machine. The system includes a headbox having a nozzle bring adapted to produce a pulp suspension jet across a width of the machine, at least one rotating screen positioned to receive the pulp suspension jet, and at least two deckle plates adjacent to the screen. The deckle plates may be adjustably positionable such that a distance between the deckle plates and a centerline of the screen is adjustable in a machine direction over a substantial portion of a length of the side shields.

In accordance with another feature of the present invention, at least one of the at least two deckle plates includes an angular adjustment device that is adapted to adjust an angular orientation of the at least one deckle plate around an axis substantially parallel to a direction transverse to the machine direction with respect to the screen.

In accordance with another feature of the present invention, at least one of the at least two deckle plates includes a spacing device that is adapted to adjust a distance between the at least one deckle plate and the screen. Further, the spacing device is adapted to adjust a substantially parallel spacing between the at least one side shield and the screen.

In accordance with a further feature of the present invention, the at least two deckle plates are elastic in the machine direction. Further, the at least two deckle plates include elastic portions.

In accordance with still another feature of the present invention, the at least two deckle plates include at least one joint having an axis that extends substantially perpendicular to a surface of the screen.

In accordance with still another feature of the present invention, the at least two deckle plates includes at least one shaping device that is adapted to adjust a contour of the at least two deckle plates in at least the machine direction. Further, the at least one shaping device is adapted to provide at least one of a tensile and pressure force in the cross machine direction. The at least two side shields include a lever arm positioned on a side of a respective side shield, and the at least one shaping device is coupled to the lever arm and is adapted to provide at least one of a tensile and pressure force in the machine direction.

In accordance with a still further feature of the present invention, the As fourdrinier machine is adapted to produce one of a paper and cardboard web.

In accordance with another feature of the present invention, at least one of the at least two side shields includes at least a first and second thick-walled section and at least a first and second elastic portion. The first elastic portion is adapted to adjustably couple the first thick-walled section to the headbox, and the second elastic portion is adapted to adjustably couple the second thick-walled section to the first thick-walled section. Further, the system includes at least a first and second adjustment rod such that the first adjustment rod is adapted to angularly adjust the first thick-walled section relative to the headbox and the second adjustment rod is adapted to angularly adjust the second thick-walled section relative to the first thick-walled section.

The present invention is also directed to a method of forming a sheet on a fourdrinier machine that includes deckle plates positioned adjacent to a rotating screen. The method includes directing a pulp suspension jet onto the rotating shield between the deckle plates to form a web sheet, moving the web sheet in a machine direction, and adjusting a distance between the deckle plates as the web sheet is moved in the machine direction.

In accordance with another feature of the present invention, the method includes moving the deckle plates relative to a surface of the rotating screen to form an opening. In this manner, a substantial portion of transverse impulses in the pulp suspension escape through the opening. Further, the deckle plates may be moved substantially perpendicularly relative to the rotating screen. Still further, the method includes adjusting an angular orientation between the deckle plates and the surface of the rotating screen. In this manner, the opening changes along the machine direction.

In accordance with still another feature of the present invention, the adjustment of the distance between the deckle plates includes adjusting an angular orientation of the deckle plates with respect to the machine direction. Further, the adjustment of the angular orientation bending a surface of the deckle plate to be directed outwardly with respect to the web sheet.

The present invention is also directed to a method for reducing wavy edges in a pulp suspension application area of a sheet formation system of a fourdrinier machine. The fourdrinier machine includes mechanical deckle plates and a rotating screen, and the method includes positioning the mechanical deckle plates in the pulp suspension application area to form edges of the sheet being formed, in which the mechanical deckle plates having a flat surface being adapted to face the pulp suspension, and bending the flat surface of the mechanical deckle plates as the formed sheet travels in a machine direction.

In accordance with another feature of the present invention, the method includes forming an opening between the mechanical deckle plates and a surface of the rotating screen, and adjusting a distance between the mechanical deckle plates and a surface of the rotating screen. In this manner, a substantial portion of transverse impulses in the pulp suspension escape through the opening.

In accordance with still another feature of the present invention, the modification of the flat surface of the mechanical deckle plates includes increasing a distance between the mechanical deckle plates in the machine direction. The increasing distance is based upon a continuity equation for incompressible liquids, subject to changing speed of flow. In this manner, a layer height of the pulp suspension remains substantially constant in a vicinity of the edges.

In accordance with a further feature of the present invention, the method includes forming an opening between the mechanical deckle plates and a surface of the rotating screen, and adjusting an angular orientation of the mechanical deckle plates and a surface of the rotating screen in the machine direction.

In accordance with yet another feature of the present invention, the method including outwardly extending a width of the pulp suspension as the pulp suspension is guided along the machine direction. Further, the method includes reducing a reflection of secondary flows from the mechanical deckle plates.

It is apparent that the presently disclosed features of the present invention, which are to be further explained in the following, can be used not only with the respectively specified combination, but also with other combinations or individually, without departing the framework of this invention.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of preferred embodiments of the present invention, in which like reference numerals represent similar parts throughout the several views of the drawings, and wherein.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Figure 1:
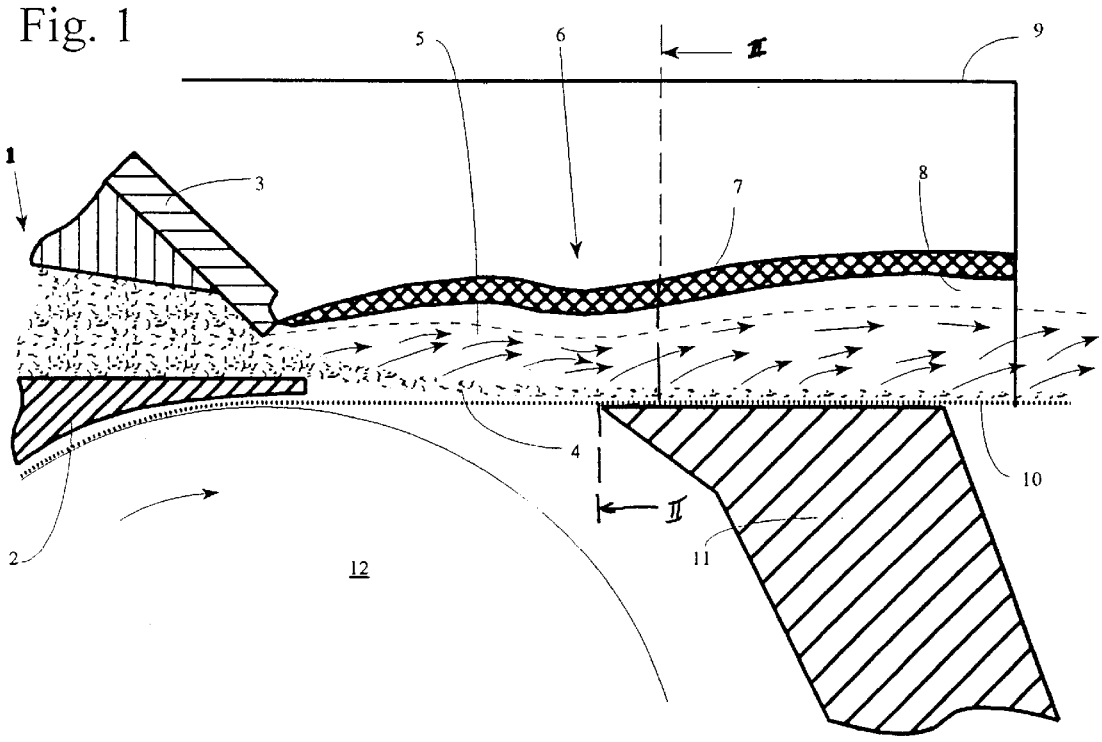
FIG. 1 illustrates a longitudinal section in an area of a jet impact point of a sheet formation area.

FIG. 1 illustrates a partial view of a longitudinal section of a sheet formation system. A nozzle area of a headbox 1 is arranged on the left-hand side of the figure and includes a lower lip 2 and an orifice 3 located above lower lip 2. Pulp suspension is pressed or dispensed through the nozzle opening between orifice 3 and lower lip 2 and, at a jet impact point 6, contacts a screen 10 that is guided beneath jet impact point 6. Screen 10 is guided over a breast roll 12 and across a horizontal screen table 11. Over the pulp suspension layer, a secondary flow 5 (indicated by the arrows) develops. In addition, a laterally attached deckle plate 9 is shown having a dried-on pulp area 7 and wet area 8 beneath dried on area 7 on its wall area.

Figure 2:
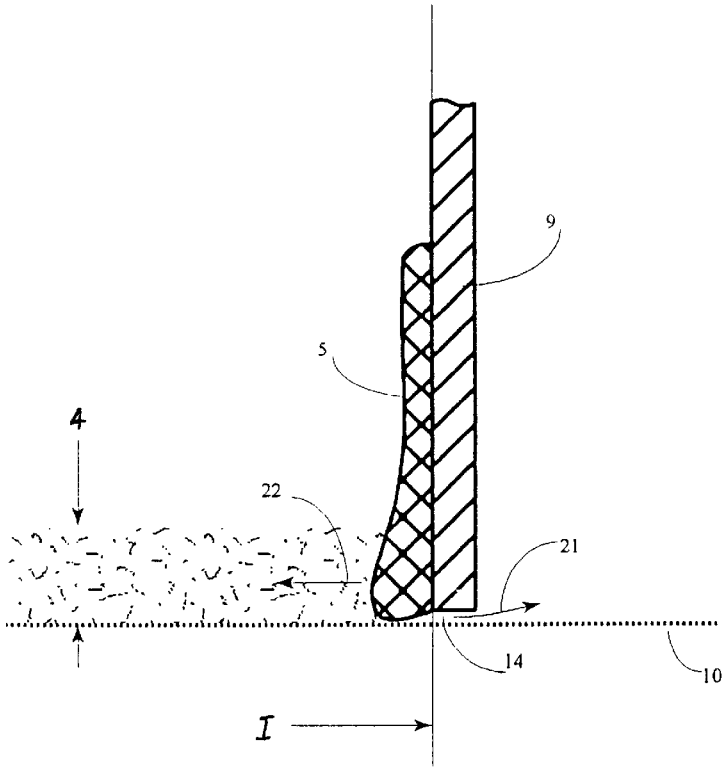
FIG. 2 illustrates a sectional view along line II—II depicted in FIG. 1.

The cross section II—II of FIG. 1 is illustrated in FIG. 2. FIG. 2 shows a section through screen 10 and deckle plate 9, and shows that deckle plate 9 is adjustable substantially perpendicular to screen 10 to form a distance 14 therebetween. Between deckle plates 9, a pulp suspension layer 4 develops as a result of secondary flow 5 and pulp suspension layer 4 has a tendency to creep upwardly along the side wall of side shield 9. By moving of deckle plate 9, an adjustment of distance 14 is effected, and the tendency of pulp suspension layer 4 to creep upwardly may be substantially reduced. This reduction occurs because a pressure impulse of secondary flows 5 may be diverted through opening 14, as depicted by arrow 21, instead of being reflected back toward a center of the forming web, as depicted by arrow 22. Thus, the pressure impulse, or at least an essential component of the pressure impulse, escapes between screen 10 and deckle plate 9.

Figure 3:
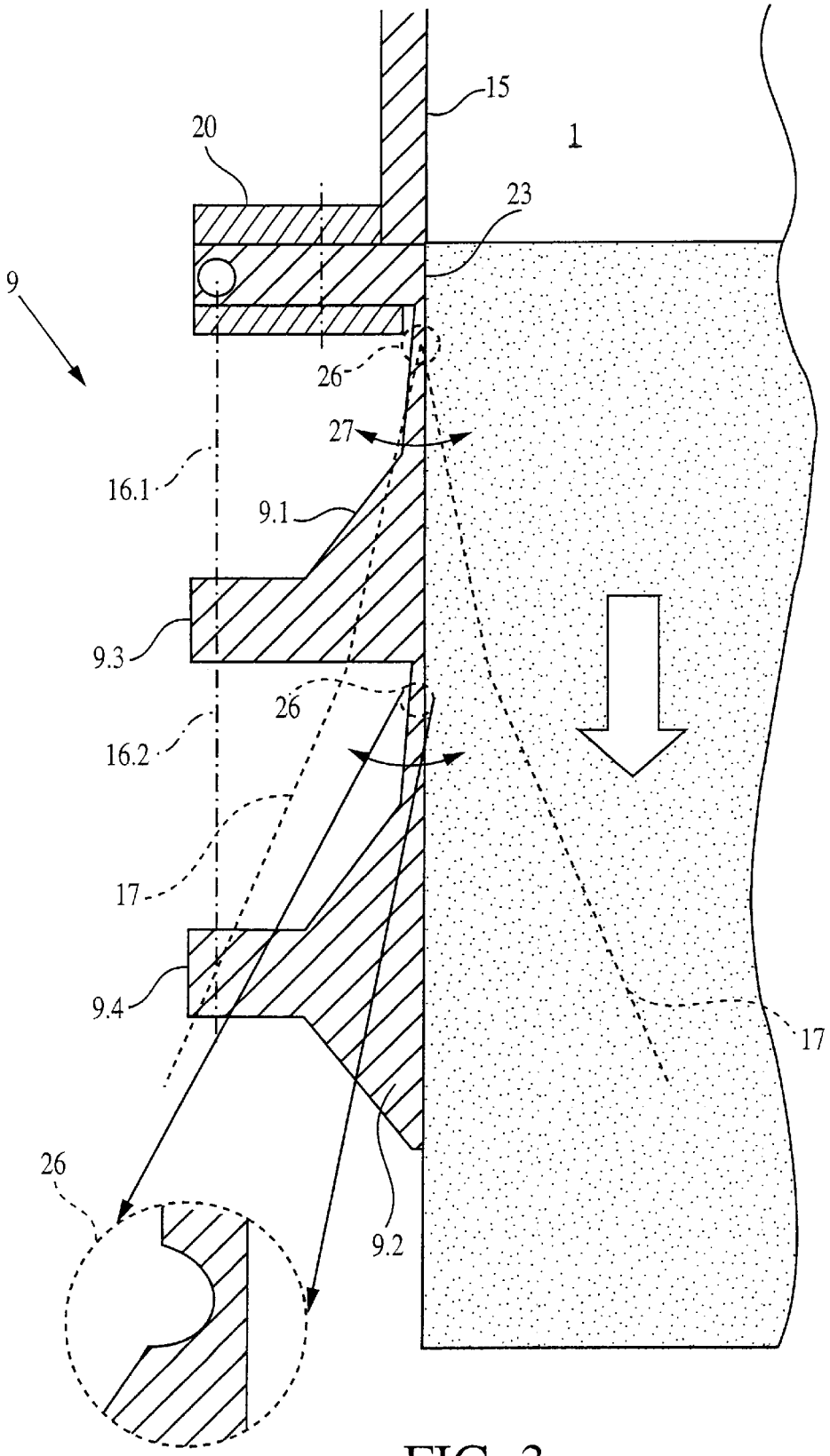
FIG. 3 illustrates a top view of a deckle plate in accordance with the present invention.

Secondary flows, and wavy edges, may also be reduced as shown in FIG. 3. FIG. 3 illustrates a top view of FIG. 1, and, in top-to-bottom perspective, shows the nozzle area of headbox 1 provided with a side wall 15. Deckle plate 9 may be coupled to side wall 15 via an adjusting device 20. Deckle plate 9 may include at least two interconnecting segments 9.1 and 9.2 that are respectively composed of a relatively thick-walled main area and a thinner, elastic transition area 26. In the exemplary embodiment, the side wall of deckle plate 9 facing the pulp suspension layer may be substantially linear. Thick-walled main areas 9.1 and 9.2 may include lateral brackets (or lever arms) 9.3 and 9.4, respectively, that are coupled to adjusting device 20 through adjusting rods 16.1 and 16.2 arranged in a machine direction.

An adjustment in the length of adjusting rods 16.1 and 16.2 results in an elastic change in a shape of deckle plate 9, i.e., in elastic transition area 26 due to a reduced moment of resistance. Deckle plate 9 negligibly moves in the machine direction of the web, and, therefore, is able to make available the necessary space for the free flow of the pulp suspension, without requiring a change in height of the suspension.

A possible, but exaggerated front line of deckle plate 9 is depicted in FIG. 3 by dotted line 17. Preferably, deckle plate 9 may be made of, e.g., synthetic material or stainless steels. Elastic areas 26 can increase in elasticity such that a weakening of material strength may be produced in area 26.

For clarification, a magnified inset of an exemplary weakness of area 26 is depicted in FIG. 3. This weakening of the material strength provides elasticity of the material and mobility of deckle plate 9 around an axis substantially perpendicular to screen level 10. In this manner, deckle plate 9 may be aligned in a desired fashion. Alignment of deckle plates 9 may occur such that a level of deckle plate 9 in contact with the material suspension may assume an angle depicted by double arrows 27 at both sides of the web. In special cases, it may be advantageous that the orientation angle of upstream deckle plate 9.1 in the machine direction points away from a center line of the screen and the orientation angle of downstream deckle plate 9.2 in the machine direction points toward the centerline of the screen, or vice versa.

Figure 4:
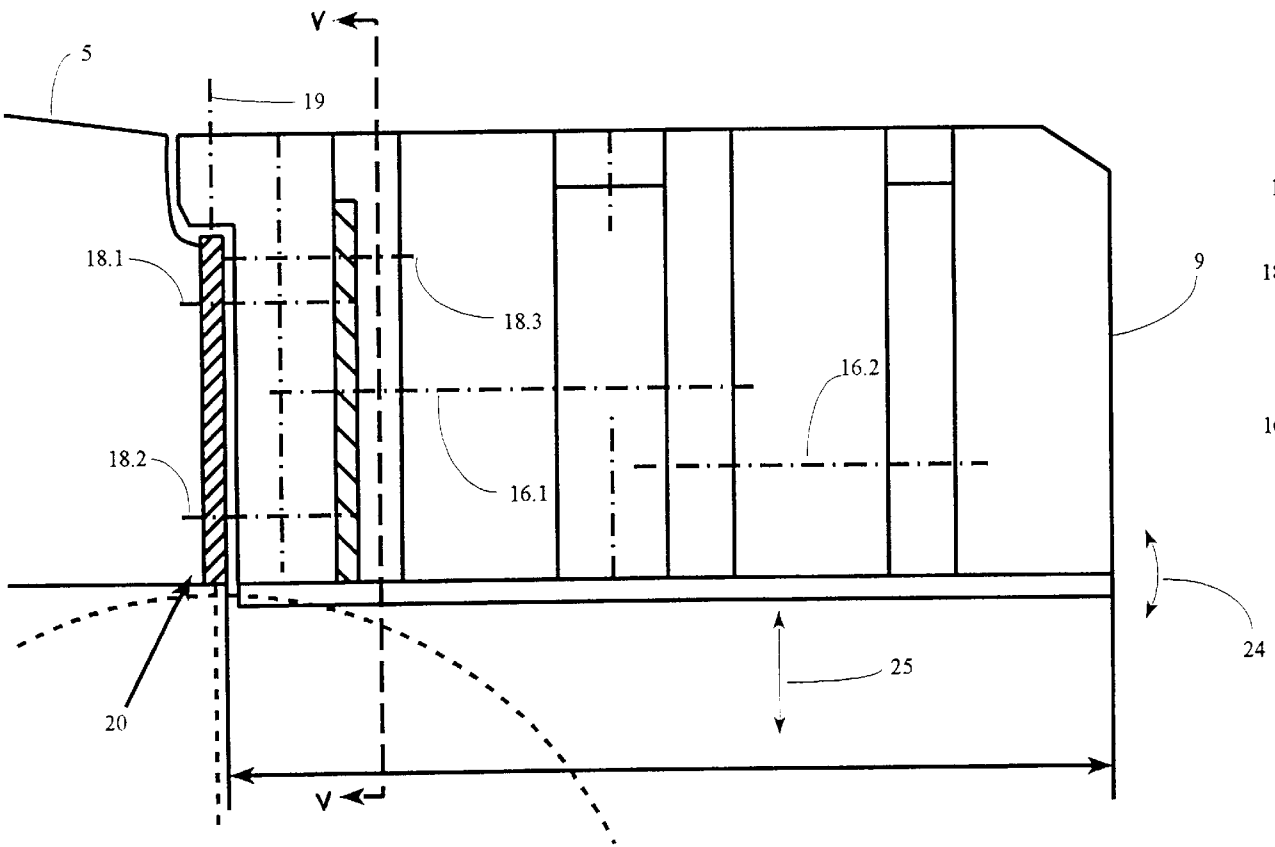
FIG. 4 illustrates a lateral view of the deckle plate in accordance with the present invention.

FIG. 4 shows a lateral view of the exemplary embodiment of deckle plate 9. In this illustration, arrangement of longitudinal adjustment rods 16.1 and 16.2 of deckle plate 9 is more clearly depicted. Deckle plate 9 may be coupled to side wall 15 of headbox 1 via screw connection by adjusting screws 18.1, 18.2 and 18.3. By adjusting any or all of adjusting screws 18.1, 18.2 and 18.3, an angle of deckle plate 9 with respect to screen 10 may be adjusted, as shown by pivoting angle 24. In this way, any or all of adjusting screws 18.1, 18.2, and 18.3 can be included in an angular adjustment device to enable adjustment of an angular orientation of deckle plate 9 around an axis substantially parallel to a direction transverse to the machine direction with respect to screen 10. Further, the distance between deckle plate 9 and screen 10, i.e., space adjustment 25, may be adjusted via an adjusting screw 19. In this manner, the distance of opening 14 between deckle plate 19 and screen 10 may be adjusted as well as the angle of orientation between deckle plate 9 and screen 10 to vary the distance of opening 14 in the machine direction, i.e., along the length of deckle plate 9. Further, via adjusting rods 16.1 and 16.2, a bending of deckle plates 9 in the longitudinal direction can be adjusted.

Figure 5:
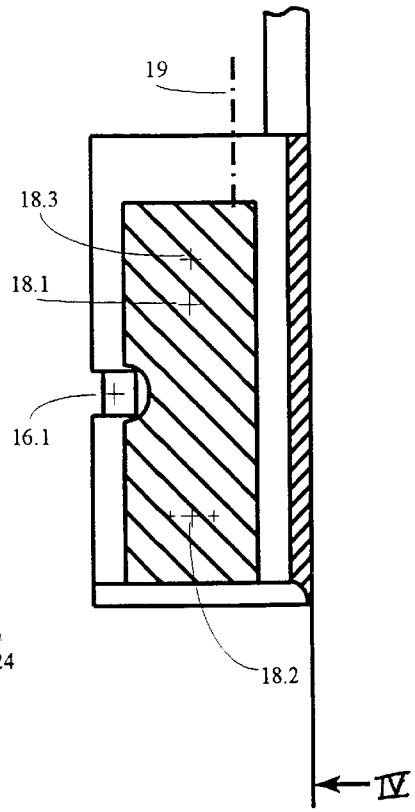
FIG. 5 illustrates a sectional view along line V—V depicted in FIG. 4.

A section V—V of FIG. 4 is shown in FIG. 5, which uses the same references numerals to more clearly indicate an arrangement of the adjustment screws 18.1, 18.2, 18.3, and 19. Via the illustrated embodiment of deckle plate 9 in accordance with the present invention, wavy edges are considerably reduced at the beginning of the sheet formation system in comparison to the prior art. Thus, an overall quality of paper or cardboard is improved.

It is noted that the foregoing examples have been provided merely for the purpose of explanation and are in no way to be construed as limiting of the present invention. While the present invention has been described with reference to a preferred embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

List of Terms

| | |
|---|---|
| 1 | Headbox |
| 2 | Lower lip |
| 3 | Orifice |
| 4 | Pulp suspension layer |
| 5 | Secondary flow |
| 6 | Pressure impulse at jet impact point |
| 7 | Dried-on pulp area |
| 8 | Wet area |
| 9 | Deckle plate |
| 9.1 | Segments |
| 9.2 | Segments |
| 9.3 | Brackets |
| 9.4 | Brackets |
| 10 | Screen |
| 11 | Screen table |
| 12 | Breast roll |
| 14 | Opening |
| 15 | Side wall |
| 16.1 | Adjusting rods |
| 16.2 | Adjusting rods |
| 17 | Line |
| 18.1 | Adjusting screws for angle adjustment |

-continued

| List of Terms | |
|---|---|
| 18.2 | Adjusting screws for angle adjustment |
| 18.3 | Adjusting screws for angle adjustment |
| 19 | Adjusting screws for space adjustment |
| 20 | Adjusting device |
| 21 | "Released" pressure impulse |
| 22 | Reflected pressure impulse |
| 23 | Seal |
| 24 | Pivoting angle |
| 25 | Space adjustment |
| 26 | Weakening area |

What is claimed is:

1. A sheet formation system of a fourdrinier machine comprising:

a headbox having a nozzle being structured and arranged to produce a pulp suspension jet across a width of the machine;

at least one rotating screen positioned to receive the pulp suspension jet;

at least two deckle plates adjacent to the screen;

the deckle plates being adjustably positionable such that a distance between the deckle plates and a centerline of the screen is adjustable in a machine direction over a substantial portion of a length of the deckle plates; and at least one of the at least two deckle plates comprising an angular adjustment device being structured and arranged to adjust and angular orientation of the at least one deckle plate around an axis substantially parallel to a direction transverse to the machine direction with respect to the screen.

2. The sheet formation system in accordance with claim 1, at least one of the at least two deckle plates comprising a spacing device being structured and arranged to adjust a distance between the at least one deckle plate and the screen.

3. The sheet formation system in accordance with claim 2, the spacing device being structured and arranged to adjust a substantially parallel spacing between the at least one deckle plate and the screen.

4. The sheet formation system in accordance with claim 1, the at least two deckle plates each being elastic in the machine direction.

5. The sheet formation system in accordance with claim 4, the at least two deckle plates each comprising elastic portions.

6. The sheet formation system in accordance with claim 1, the at least two deckle plates each comprising at least one joint having an axis extending substantially perpendicular to a surface of the screen.

7. The sheet formation system in accordance with claim 1, the at least two deckle plates comprising at least one shaping device being structured and arranged to adjust a contour of the at least two deckle plates in at least the machine direction.

8. The sheet formation system in accordance with claim 7, the at least one shaping device being structured and arranged to provide at least one of a tensile and pressure force in a cross machine direction.

9. The sheet formation system in accordance with claim 7, the at least two deckle plates comprising a lever arm positioned on a side of a respective deckle plate; and the at least one shaping device being coupled to the lever arm and being structured and arranged to provide at least one of a tensile and pressure force in the machine direction.

10. The sheet formation system in accordance with claim 1, the fourdrinier machine being structured and arranged to produce one of a paper and cardboard web.

11. The sheet formation system in accordance with claim 1, at least one of the at least two deckle plates comprising:

at least a first and second thick-walled section;

at least a first and second elastic portion;

the first elastic portion being adapted to adjustably couple the first thick-walled section to the headbox; and the second elastic portion being structured and arranged to adjustably couple the second thick-walled section to the first thick-walled section.

12. The sheet formation system in accordance with claim 11, further comprising:

at least a first and second adjustment rod;

the first adjustment rod being structured and arranged to angularly adjust the first thick-walled section relative to the headbox; and the second adjustment rod being structured and arranged to angularly adjust the second thick-walled section relative to the first thick-walled section.

13. A method of forming a sheet on a fourdrinier machine that includes deckle plates positioned above and adjacent to a rotating screen, the method comprising:

directing a pulp suspension jet onto the rotating screen between the deckle plates above and adjacent to the rotating screen to form a web sheet;

moving the web sheet in a machine direction; and adjusting a distance between the deckle plates as the web sheet is moved in the machine direction, such that a distance between the deckle plates changes in the machine direction.

14. The method in accordance with claim 13, further comprising:

moving the deckle plates relative to a surface of the rotating screen to form an opening, whereby a substantial portion of transverse impulses in the pulp suspension escape through the opening.

15. The method in accordance with claim 14, wherein the deckle plates are moved substantially perpendicularly relative to the rotating screen.

16. The method in accordance with claim 15, further comprising:

adjusting an angular orientation between the deckle plates and the surface of the rotating screen, whereby the opening changes along the machine direction.

17. The method in accordance with claim 13, the adjustment of the distance between the deckle plates comprising:

adjusting an angular orientation of the deckle plates with respect to the machine direction.

18. The method in accordance with claim 17, the adjustment of the angular orientation comprising:

bending a surface of the deckle plate to be directed outwardly with respect to the web sheet.

19. The method in accordance with claim 13, further comprising angularly adjusting an angular orientation of at least one of the deckle plates around an axis substantially parallel to a direction transverse to the machine direction relative to the surface of the rotating screen.

20. A method for reducing wavy edges in a pulp suspension application area of a sheet formation system of a fourdrinier machine, the fourdrinier machine including mechanical deckle plates and a rotating screen, the method comprising:

positioning the mechanical deckle plates above the rotating screen and in the pulp suspension application area to form edges of the sheet being formed, the mechanical deckle plates having a flat surface being adapted to face the pulp suspension; and bending the flat surface of the mechanical deckle plates as the formed sheet travels in a machine direction to adjust a distance between the mechanical deckle plates in a machine direction.

21. The method in accordance with claim 20, further comprising:

forming an opening between the mechanical deckle plates and a surface of the rotating screen; and adjusting a distance between the mechanical deckle plates and a surface of the rotating screen, whereby a substantial portion of transverse impulses in the pulp suspension escape through the opening.

22. The method in accordance with claim 20, wherein the bending of the flat surface of the mechanical deckle plates comprising increasing a distance between the mechanical deckle plates in the machine direction;

wherein the increasing distance is based upon a continuity equation for incompressible liquids, subject to changing speed of flow, whereby a layer height of the pulp suspension remains substantially constant in a vicinity of the edges.

23. The method in accordance with claim 20, further comprising:

forming an opening between the mechanical deckle plates and a surface of the rotating screen; and adjusting an angular orientation of the mechanical deckle plates and a surface of the rotating screen in the machine direction.

24. The method in accordance with claim 20, further comprising:

outwardly extending a width of the pulp suspension as the pulp suspension is guided along the machine direction.

25. The method in accordance with claim 24, further comprising:

reducing a reflection of secondary flows from the mechanical deckle plates.

26. The method in accordance with claim 20, wherein the fourdrinier machine is adapted to produce one of a paper and cardboard web.

27. An apparatus for a fourdrinier machine comprising:

a nozzle being structured and arranged to produce a pulp suspension jet across a width of the machine, said nozzle being orientable to direct the pulp suspension jet at an impact point;

at least two deckle plates coupled to opposite sides of said nozzle, such that the impact point is located between said at least two deckle plates; and said at least two deckle plates being adjustably positionable above a forming screen such that a distance between the deckle plates and a centerline between the deckle plates in a machine direction is adjustable and changes over a substantial portion of a length of said deckle plates.

28. The apparatus in accordance with claim 27, further comprising an angular adjustment device coupled to at least one of said at least two deckle plates, said angular adjustment device being structured and arranged to adjust an angular orientation of the at least one deckle plate around an axis substantially parallel to a direction transverse to the machine direction with respect to the screen.

* * * * *